US006107758A

United States Patent [19]

Fischer et al.

[11] Patent Number: 6,107,758

[45] Date of Patent: Aug. 22, 2000

[54] OPERATION CIRCUIT IN PARTICULAR FOR DISCHARGE LAMPS USING DISCRETE TIME DEFINITION VALUES TO CONTROL OPERATION STATE SWITCHING

[75] Inventors: Klaus Fischer, Augsburg, Germany; Roberto Gariboldi, Lacchiarella; Giuseppe Cantone, Siracusa, both of Italy

[73] Assignees: Patent-Treuhand-Gesellschaft fuer elektrische Gluehlampen mbH, Munich, Germany; STMicroelectronics S.r.l., Agrate Brianza, Italy

[21] Appl. No.: 09/404,723

[22] Filed: Sep. 23, 1999

[30] Foreign Application Priority Data

Sep. 29, 1998 [EP] European Pat. Off. ..... 98118405

[51] Int. Cl.[7] ..... H05B 37/02

[52] U.S. Cl. ..... 315/362; 315/313

[58] Field of Search ..... 315/313, 320, 315/362, 314, 315

[56] References Cited

U.S. PATENT DOCUMENTS

| | | |
|---|---|---|
| 4,879,495 | 11/1989 | Yamamoto . |
| 4,896,079 | 1/1990 | Tabor . |
| 5,610,448 | 3/1997 | Dattilo . |
| 5,729,097 | 3/1998 | Holzer . |
| 5,798,620 | 8/1998 | Wacyk et al. . |

FOREIGN PATENT DOCUMENTS

| | | |
|---|---|---|
| 19629207 | 1/1998 | Germany . |
| 19644993 | 5/1998 | Germany . |

*Primary Examiner*—David Vu
*Attorney, Agent, or Firm*—Carlo S. Bessone

[57] ABSTRACT

A circuit is described with which an operation circuit for a discharge lamp can be switched between operation states with different lamp currents by short interruptions of the power supply. Long interruptions than a certain time threshold result in basic state operation.

8 Claims, 4 Drawing Sheets

OPERATION CIRCUIT IN PARTICULAR FOR DISCHARGE LAMPS USING DISCRETE TIME DEFINITION VALUES TO CONTROL OPERATION STATE SWITCHING

BACKGROUND OF THE INVENTION

This invention relates to an operation circuit for a load. In particular this load can be a discharge lamp, especially a compact fluorescent lamp.

Discharge lamps and other loads are operated by means of operation circuits or powering circuits which comprise e.g. a half bridge oscillator with AC power supply. The AC power supply is rectified by a rectifier and smoothed by a relatively large electrolyte capacitor. This half bridge oscillator produces a high-frequency AC power and thus provides for a discharge lamp operation without flicker or acoustic noise.

One major disadvantage of discharge lamps compared to incandescent lamps is the lack of a dim function. However, there is one recent solution in prior art which has resulted in an improvement at this point. According to this proposal, an interruption of the power supply of an operation circuit for a discharge lamp is used so to say as a trigger signal for switching to a different operation state with a larger or a smaller lamp current when the lamp starts again. In this way, two different operation states with different lamp currents can be discriminated and switched and thus the lamp power can be reduced similar to a dim function. This prior art is given in EP 0 488 002 B1 and the corresponding priority application DE 40 37 948.

SUMMARY OF THE INVENTION

Based on this prior art, the present invention has the object to solve the problem of providing a reliable and comfortable operation circuit enabling the user to switch between different operation states. This problem is solved by means of a circuit for operating a load, in particular a discharge lamp, comprising an operation state storage device for storing a quantity representing an operation state of the load and an operation state switching device for switching between a plurality of operation states, activated at each shorter interruption of power supply of the operation circuit to switch to an operation state different from the operation state represented by the quantity stored in the operation state storage means, characterized in further comprising a separate time definition circuit with capacitive element and a discrete value producing device, for defining a certain time period by a capacitive charge or discharge operation and outputting a discrete output value depending on the charge state of the capacitive element, for discriminating longer interruptions of the power supply from shorter interruptions, the operation states switching means being activated to switch to a given basic operation state by longer interruptions.

According to the invention, it is intended to let longer interruptions of the power supply result in a "reset" of the operation circuit to a given basic operation state. In contrast to this, shorter interruptions of the power supply activate the switching function and thus lead to a different operation state after the interruption.

Principally, these functions are already described in EP 0 488 002 B1 cited above. However, the function of switching the bistable switching system described in this document to a given basic state is mentioned only as a function that shall be provided. The cited document gives no hint leading to a real technical solution for realizing this intended function.

Based on this predescribed object, it seems to be a direct approach to implement a storage means for the last operation state (or the coming operation state) in such a manner that it looses its stored contents after a certain time period has elapsed. It would be necessary to let this loss of storage contents lead to a definite basic state of the storage means. More concrete, a capacitor could be used to store the operation state. This capacitor would be discharged with a certain time function in case of a power supply interruption, and after a certain time period the capacitor would have the state "empty".

The present invention is based on the following ideas. By the obvious way described above, two functions are implemented in the same unitary device. According to this invention, however, these two functions should better be separated. Accordingly, the invention contemplates to separate the function "store operation state" and the function "define time threshold for power supply interruption", i.e. to provide a time definition circuit separate from the operation state storage device.

Further, the inventors have realized, that an analog output value typically produced by a time definition circuit (e.g. RC-element) is not optimal to control the above described reset operation. Therefore, the invention is further based on the feature to include a discrete value producing device that outputs a discrete output value depending on the length of the power supply interruption. This discrete value is used to control whether the load starts in a different operation state from the former operation state for any former operation state, or starts in a predefined basic operation state.

According to the invention, the separation between the time definition circuit and the operation state storage device can be used, just as an example, to let the time definition circuit function as a storage for the operation state to come after a future short power supply interruption, at the same time. However, the present or just past operation state is stored in the operation state storage device and can be used e.g. to produce a set value for a feed back control.

In conclusion, the invention provides an operation circuit that can switch between different operation states by means of short power supply interruptions and is reset to a basic operation state if the power supply interruption is longer than a certain threshold value. These functions are realized in a reliable circuit which, because of the discrete value producing device, avoids indefinite borderline states between shorter and longer interruptions. The realized functions of the operation circuit improve the comfort of usage of the circuit and the load.

A simple and preferred choice for the discrete value producing means is a comparator, as shown in the preferred embodiment. Comparators are relatively simple devices the threshold of which usually can be tuned according to the special application. A continuously increasing or decreasing output of the time definition circuit is transformed to a discrete value output by the comparator, that always gives a well defined basis to discriminate between shorter and longer interruptions. In the preferred embodiment shown below, the operation state storage device is a flip-flop which has an indefinite input value region between the inputs leading to the one and inputs leading to the other flip-flop state. If a Schmitt trigger is included in the flip-flop's input the indefinite border line region can be avoided, however, a relevant hysteresis of the threshold results as a consequence of the Schmitt trigger. Since the hysteresis leads to a dependency of the threshold value on the state of origin, again the discrimination between shorter and longer interruptions is not clear and definite. Therefore, the embodiment uses a comparator as mentioned above.

Especially in view of the above outlined solution with a storage function of the time definition circuit for the future operation state, a two-switch or two-transistor circuit controlled by the operation state storage means can be used to charge and discharge the capacitive element of the time definition circuit, as a simple circuit configuration. Then, the charge state of the capacitive element can be regarded to represent the future operation state. The charge state "full" discharges over a certain time period (by means of a discharge element) and thus simultaneously provides for time definition. The charge state "empty" remains stable and thus is to be identified with the operation state defined as the basic state. The capacitive element, however, is not the operation state storage device itself, which is a flip-flop in the preferred embodiment. If it was, short interruptions of the power supply would not lead to a change of the charge state of the capacitive element and thus not provide for a switching function.

Instead of the two-transistor circuit also a combination of one switch or one transistor and a pull-down or pull-up resistor could be used. However, with a low value of the resistor the current consumption increases whereas with the high value of the resistor the response time increases. Thus, a resistor transistor circuit always represents a trade-off between these two aspects. For this reason, the above given two-transistor circuit is advantageous in combining a fast response time with a low power consumption.

As already mentioned above, the operation state storage means of the preferred embodiment described below is implemented in the form of a flip-flop. In this preferred case, the two outputs (non inverting and inverting) of the flip-flop are both used for control purposes. The one controls the operation state switching device in order to define the operation state of the operation circuit and the load depending on the storage contents of the operation state storage device. The other, which is inverted compared to the first one, defines the charge state of the capacitive element by feed back. In connection with the above two-transistor circuit this second output of the flip-flop can be supplied to the gates or bases of the two transistors. The charge state defined thereby can be regarded as the future operation state if it is inverted to the present one and if the circuit is configured to provide for the reset function as outlined above.

As explained below in detail, it is preferred to provide for a circuit that switches off both switches or transistors during a power supply interruption in order to let the charge state of the capacitive element decay in a definite manner. If not, the problem arises, that the charge state decay of the capacitive element can be influenced by indefinite states of other circuit parts during the absence of the supply voltage.

Having described the invention in general terms, in the following description a preferred embodiment for the invention will be described in detail. The details and features given there are regarded to be of importance also in other combinations or as individual features for themselves.

BRIEF DESCRIPTION OF THE DRAWINGS

The embodiment is shown in the accompanying figures wherein.

DESCRIPTION OF THE PREFERRED EMBODIMENTS

Figure 1:
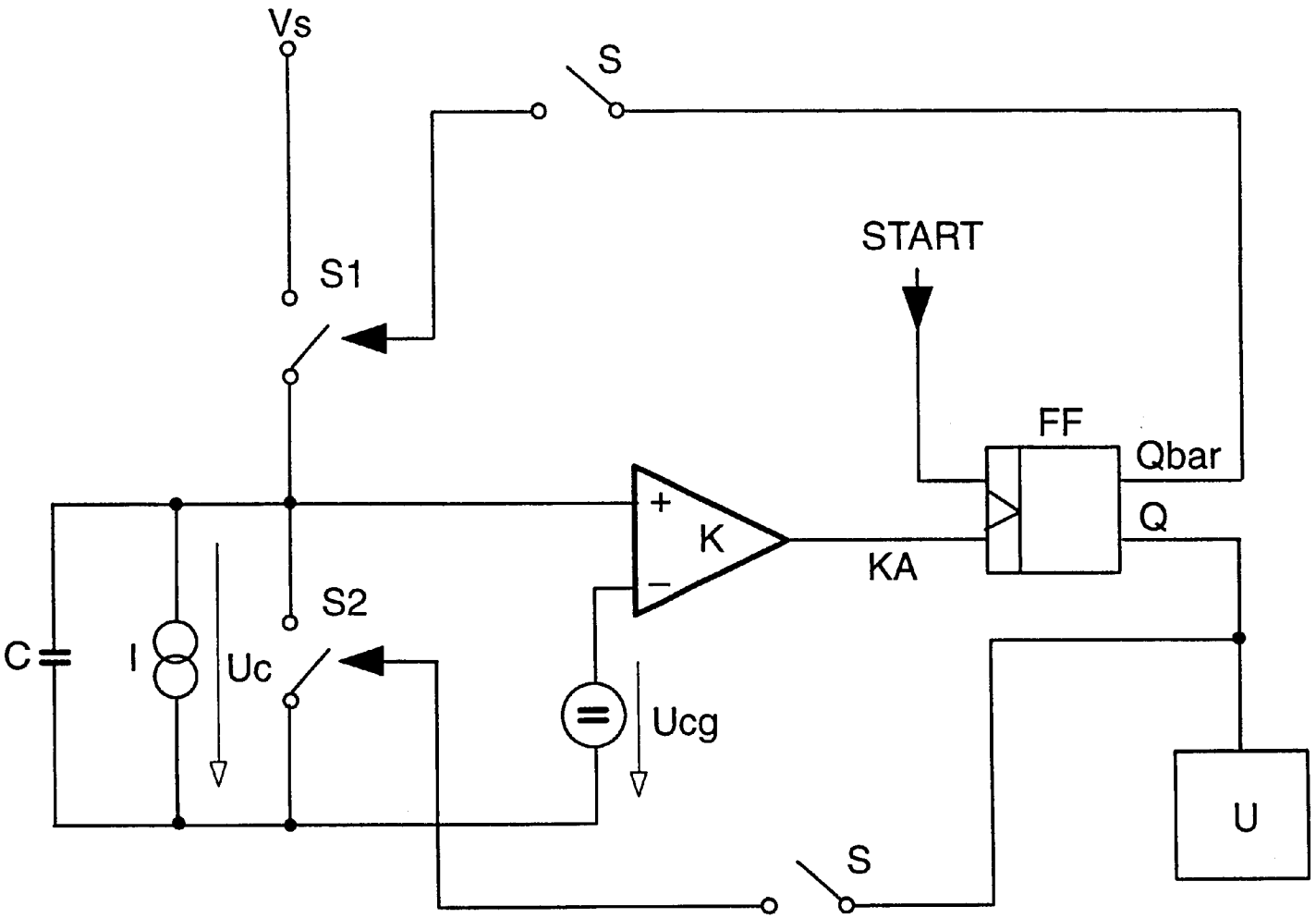
FIG. 1 is a schematic circuit configuration according to the invention.

In FIG. 1, conventional parts of an operation circuit for a low pressure discharge lamp are omitted. In principle, an AC power supply is rectified by a conventional rectifier and capacitively smoothed to be transformed into a high frequency AC power for the discharge lamp by means of a transistor half bridge oscillator.

Shown in FIG. 1 is only the part of such a circuit typical for the invention. A flip-flop FF as an implementation of the operation state storage device supplies its output Q to an operation state switching device U which is a feed back control circuit for the lamp power. The second inverted output Qbar is fed back across a switch S to activate a first switch S1 of a two-switch half-bridge construction. The first output Q, on the other hand, is also fed back across a second pole of the same switch S to a second switch S2 of said half bridge. Thus, the activation of switch S switches one of the two switches S1 and S2 of the half bridge in the open position and the other one in the closed position and vice versa.

This half-bridge construction has a time definition circuit consisting of a current source I with a parallel capacitor C between the half bridge's middle tap and the reference potential with a voltage Uc there between.

Switch S is opened during power supply interruptions when Vs is 0. For the following it is assumed that switch S is closed and the supply voltage Vs is in its normal ON state. The time definition circuit is charged or discharged depending on whether switch S1 or switch S2 is conducting or not conducting. (S being open means S1 and S2 being open independent of Q and Qbar; S being closed means S1 being closed and S2 being open if Q=0 and S2 being closed and S1 being open if Q=1.) Consequently, operation state storage device FF by means of Qbar controls the charge state of the time definition circuit built up by capacitor C and parallel current source I. After a certain time period has elapsed, the charge of the time definition circuit has fallen below a threshold value of a comparator K connected to the middle tap of the half-bridge. The reference value is defined by voltage Ucg in relation to the above reference potential. Thus, an output of the time definition circuit controls a discrete value output in comparator K the output KA of which is supplied to the above described flip-flop FF. The flip-flop or operation state storage device FF stores this value KA each time its trigger input START is activated. The storage value is given at output Q and inverted at output Qbar.

Switch S can be a semiconductor element (so called analogue switch) or a simple relay switch.

This START signal is generated by a control IC of the oscillator at each new start of the AC power supply and thus of the IC.

Figure 2:
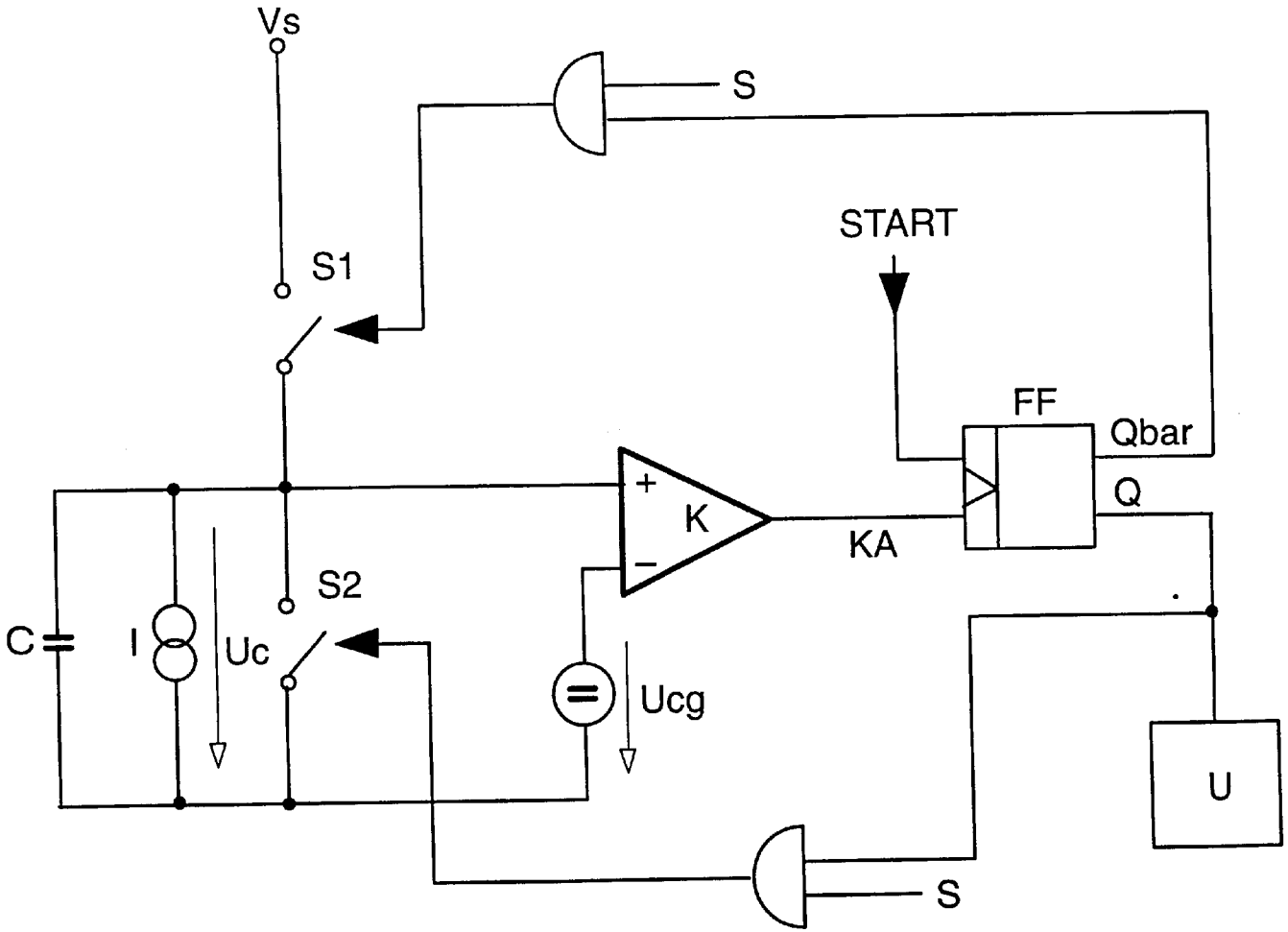
FIG. 2 is a variation to the configuration according to FIG. 1.

FIG. 2 shows a variation to the configuration of FIG. 1 in that switch S is embodied by a semiconductor logical AND-gate having Q and Qbar, respectively, as one input and an activation signal S as the other input. The rest of the figure corresponds to FIG. 1. Here, an activation signal of S=1 corresponds to the ON state and S=0 to the OFF state.

Figure 3:
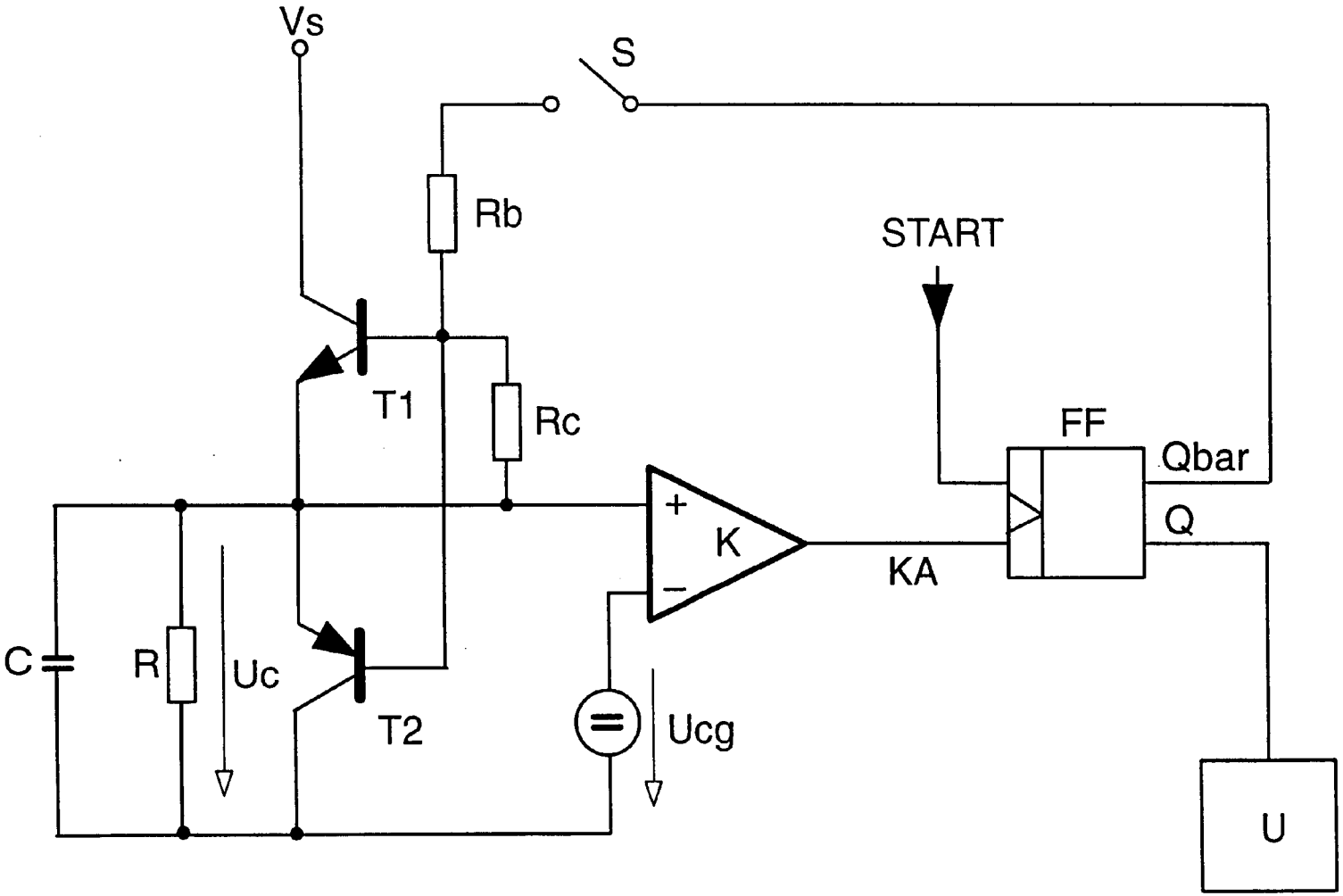
FIG. 3 is another variation according to the configuration of FIG. 1.

A further variation is shown in FIG. 3. Therein, the switches S1 and S2 are embodied as bipolar transistors (a CMOS transistor would also do) S1 being an NPN transistor and S2 a PNP transistor. Only output Qbar of flip-flop FF is connected to the basis of this bipolar transistors S1 and S2 via a single switch S and a resistor. Because of the different polarity of transistors S1 and S2, this single output Qbar switches both transistors in the manner described in connection with FIG. 1.

Further, the current source I is replaced by a simple resistor R in order to have a simple time definition circuit defined by an RC constant. This leads to an exponential decay of voltage Uc instead of the linear decay with the configurations of FIGS. 1 and 2. However, for this invention it is only necessary, that a certain time period is needed to decrease voltage Uc below the threshold value of comparator K.

A further additional detail is resistor Rc for the case of a power supply interruption. In this case, switch S is opened and said further resistor Rc connects emitter and base of transistor S1 and transistor S2, respectively, so that the opening of switch S leads to an emitter base voltage of 0 at both transistors S1 and S2. Therefore, both transistors are switched off so that the discharge of capacitor C through resistor R cannot be disturbed by indefinite states of other circuit elements because of Vs being 0.

Figure 4:
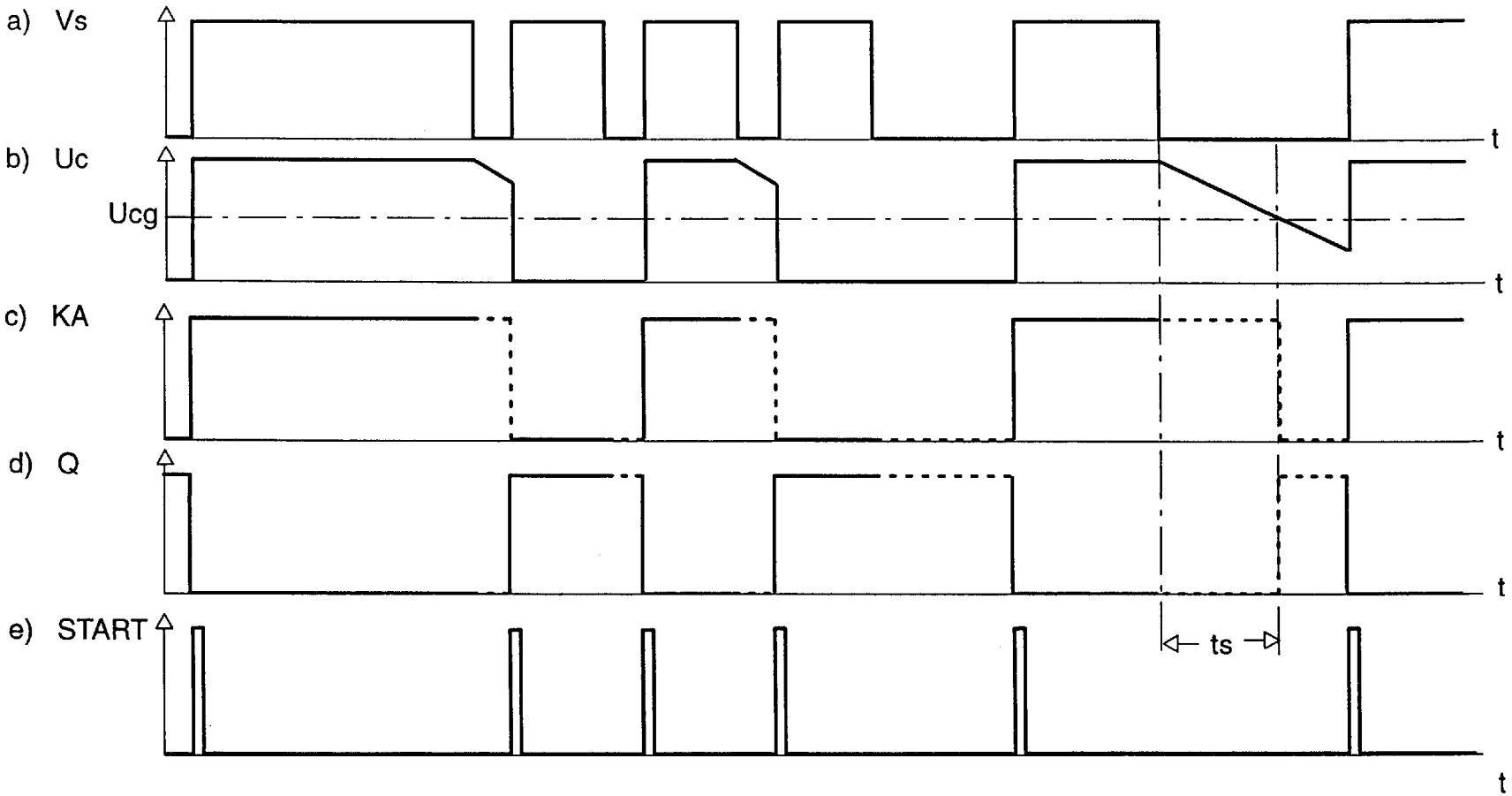
FIG. 4 is a schematic timing diagram illustrating the time dependence of various quantities in the circuit shown in FIG. 1.

FIG. 4 shows five timing diagrams to illustrate the time behaviour of five electrical quantities in the circuit of FIG. 1. In the first line named a) the DC output voltage of rectifier Vs is shown and reflects the interruptions of the AC power supply of the rectifier. First three interruptions are quite short whereas the last two interruptions are much longer.

Next line b) shows the influence of these interruptions on voltage Uc across capacitor C and second switch S2. Voltage Uc decreases linearly with the first interruption of Vs. It is to be understood that this linear decrease is a simplification of an exponential time dependence just for diagrammatical purposes. Also shown is Ucg being the threshold value of the comparator K.

During the first ON period of Vs voltage Uc is higher than Ucg and thus the output of comparator K is HIGH.

This output KA is not well defined during the OFF period of Vs and therefore shown in broken lines in FIG. 4. At the end of the first interruption of Vs a HIGH value is stored in flip-flop FF and output as output Q is shown in the 4th line d), because voltage Uc is still higher than Ucg.

The inverted output Qbar of the flip-flop FF then renders conductive switch S2 and renders non conductive switch S1 so that capacitor C discharges during this period as shown in the second line b. The START pulse generated at every start-up of the lamp, leading to the storage of KA is shown in the fifth line e).

Also outputs Q and Qbar are not well defined when supply voltage Vs is 0. Therefore output Q is drawn in broken lines in FIG. 4 in the respective periods.

The next and second interruption does not lead to a discharge of capacitor C because it is already discharged. Compare second line b where Uc remains 0. However, at the end of the second interruption the same procedure as described above is repeated with opposite sign so that the operation state of the circuit shown in FIG. 1 and also the operation state of the whole operation circuit of the lamp of the first period shown in FIG. 4 is reestablished.

A third short power supply interruption leads to the same consequences as the first one. The next long interruption can be compared to the second short interruption because the exceeding of the discharge time given e.g. by the RC-constant and by Ucg does not change the fact that capacitor C is already discharged. As a consequence, the START pulse at the end of this first long interruption again leads to a storage of KA and thus to a change of Q with a corresponding change of the operation state of the lamp. However, after the next long interruption, the last one shown in FIG. 4, voltage Uc has decreased below threshold Ucg of comparator K. Accordingly, output KA of comparator K is changed after this discharge process in which Uc has fallen below Ucg. Consequently, the value of Q remains LOW at the end of this interruption at the START pulse. The value of Q before and after the end of this power supply interruption corresponds to the above mentioned basic operation state of the operation circuit and the lamp.

In conclusion, this embodiment shows a circuit configuration with which an operation circuit of a discharge lamp can be provided with the above mentioned "operation state switching function" and the "reset after long interruptions function" in a simple and reliable manner leading to an improvement of the comfort of use.

What is claimed is:

1. Circuit for operating a load, in particular a discharge lamp, comprising an operation state storage device (FF) for storing a quantity representing an operation state of the load and an operation states switching device (U) for switching between a plurality of operation states, activated at each shorter interruption of power supply of the operation circuit to switch to an operation state different from the operation state represented by the quantity stored in the operation state storage means (FF), characterized in further comprising a separate time definition circuit (IC) with a capacitive element (C) and a discrete value producing device (K), for defining a certain time period by a capacitive charge or discharge operation and outputting a discrete output value (KA) depending on the charge state of the capacitive element (C), for discriminating longer interruptions of the power supply from shorter interruptions, the operation states switching device (U) being activated to switch to a given basic operation state by longer interruptions.

2. Operation circuit according to claim 1, wherein the discrete value producing device (K) is a comparator.

3. Operation circuit according to claim 1, wherein a first transistor (S1) of a two-transistor circuit (S1, S2) charges and a second transistor (S2) of the two-transistor circuit (S1, S2) discharges the capacitive element (C) of the time definition circuit (IC) depending on the quantity stored in the operation state storage device (FF).

4. Operation circuit according to claim 1, wherein the operation state storage device (FF) is a flip-flop, a first output (Q) of which controls the operation states switching device (U) and a second output (Qbar) of which, being inverted compared to the first output (Q), is fed back for defining the charge state of the capacitive element (C) after a shorter interruption.

5. Operation circuit according to claim 2, wherein a first transistor (S1) of a two-transistor circuit (S1, S2) charges and a second transistor (S2) of the two-transistor circuit (S1, S2) discharges the capacitive element (C) of the time definition circuit (IC) depending on the quantity stored in the operation state storage device (FF).

6. Operation circuit according to claim 2, wherein the operation state storage device (FF) is a flip-flop, a first output (Q) of which controls the operation states switching device (U) and a second output (Qbar) of which, being inverted compared to the first output (Q), is fed back for defining the charge state of the capacitive element (C) after a shorter interruption.

7. Operation circuit according to claim 3, wherein the operation state storage device (FF) is a flip-flop, a first output (Q) of which controls the operation states switching device (U) and a second output (Qbar) of which, being inverted compared to the first output (Q), is fed back for defining the charge state of the capacitive element (C) after a shorter interruption.

8. Operation circuit according to claim 5, wherein the operation state storage device (FF) is a flip-flop, a first output (Q) of which controls the operation states switching device (U) and a second output (Qbar) of which, being inverted compared to the first output (Q), is fed back for defining the charge state of the capacitive element (C) after a shorter interruption.

* * * * *